US006065991A

United States Patent [19]

Fukuda

[11] Patent Number: 6,065,991

[45] Date of Patent: May 23, 2000

[54] HALF-FITTING PREVENTION CONNECTOR

[75] Inventor: Masaru Fukuda, Shizuoka, Japan

[73] Assignee: Yazaki Corporation, Tokyo, Japan

[21] Appl. No.: 09/154,827

[22] Filed: Sep. 17, 1998

[30] Foreign Application Priority Data

Sep. 17, 1997 [JP] Japan ..... 9-252245

[51] Int. Cl.[7] ..... H01R 13/627

[52] U.S. Cl. ..... 439/352; 439/489

[58] Field of Search ..... 439/350–358, 439/729, 744, 488, 489, 345, 296, 953, 725, 732

[56] References Cited

U.S. PATENT DOCUMENTS

| | | | |
|---|---|---|---|
| 5,183,410 | 2/1993 | Inaba et al. | 439/489 |
| 5,370,543 | 12/1994 | Hamada et al. | 439/188 |
| 5,749,747 | 5/1998 | Inaba et al. | 439/358 |
| 5,785,546 | 7/1998 | Hamai et al. | 439/354 |
| 5,791,930 | 9/1998 | Tabata et al. | 439/345 |
| 5,820,399 | 10/1998 | Shirouzu et al. | 439/352 |
| 5,820,400 | 10/1998 | Yamanashi et al. | 439/358 |
| 5,827,086 | 10/1998 | Fukuda | 439/357 |
| 5,830,000 | 11/1998 | Shiflett et al. | 439/352 |
| 5,848,912 | 12/1998 | Okabe | 439/489 |
| 5,876,230 | 3/1999 | Nishide et al. | 439/352 |
| 5,910,027 | 6/1999 | Wayt et al. | 439/489 |
| 5,919,056 | 7/1999 | Suzuki et al. | 439/352 |
| 5,928,038 | 7/1999 | Berg et al. | 439/752 |
| 5,938,466 | 8/1999 | Suzuki et al. | 439/352 |
| 5,938,470 | 8/1999 | Kashiyama | 439/489 |
| 5,947,763 | 9/1999 | Alaksin | 439/489 |

FOREIGN PATENT DOCUMENTS

| | | | |
|---|---|---|---|
| 57-145288 | 9/1982 | Japan | H01R 13/639 |
| 4-306575 | 10/1992 | Japan | H01R 13/62 |
| 5-81967 | 11/1993 | Japan | H01R 13/639 |
| 10-50408 | 2/1998 | Japan | H01R 13/639 |

*Primary Examiner*—Paula Bradley
*Assistant Examiner*—Ross Gushi
*Attorney, Agent, or Firm*—Sughrue, Mion, Zinn, Macpeak & Seas, PLLC

[57] ABSTRACT

In a half-fitting prevention connector 30, a lock portion 53 and a stopper projection 55 are formed in a juxtaposed manner on a flat surface portion 47 of a female connector (one connector) 31, and the lock portion and the stopper projection are spaced a predetermined distance 51 from each other in a direction perpendicular to a connector-fitting direction. An elastic lock arm 61 and a bar-like slider 63 are formed on a male connector (the other connector) 33, and when the two connectors begin to be fitted together, the elastic lock arm is brought into sliding contact with a slanting surface 57 of the lock portion 53, and is elastically flexed toward the stopper projection 55, and the slider 63 is urged in a fitting direction through a resilient member 69, and can be pressed by the flexed elastic lock arm 61 so as to abut against the stopper projection 55. The elastic lock arm 61 and the slider 63 are covered with a cover portion 67.

4 Claims, 7 Drawing Sheets

HALF-FITTING PREVENTION CONNECTOR

BACKGROUND OF THE INVENTION

1. Field of the Invention

This invention relates to a half-fitting prevention connector in which when a pair of female and male connectors to be fitted together are half fitted together, the two connectors are moved away from each other by resiliency of a resilient member mounted on one of the two connectors, thereby detecting this half-fitted condition.

2. Related art

There have been used various types of female and male connectors by which a wire harness can be easily connected to and disconnected from an electronic equipment or an electronic part mounted on an automobile or the like. One example of such female and male connectors is a half-fitting prevention connector in which a compression spring is mounted within one of housings to be fitted together, and the two connectors, when half fitted together, are moved away from each other by the resiliency of the compression spring, thereby detecting this half-fitted condition.

In a half-fitting prevention connector shown in FIGS. 7 and 8, a pair of female and male connectors are moved away from each other through a movable cover urged by compression springs (see Japanese Utility Model Unexamined Publication No. 5-81967). The female connector 3 includes a housing 5 having a plurality of pin contacts 1 mounted therein, and the housing 5 has a hood portion 7 open in a fitting direction. The male connector 11 includes a housing 13 having a plurality of socket contacts 9 mounted therein, and the housing 13 has a fitting portion 15 for insertion into the hood portion. 7.

An engagement piece portion 17 is formed on and extends from. a top plate 5*a* of the housing 5 of the female connector 3 in the fitting direction, and an engagement projection 17*a* for fitting engagement with the mating connector is formed at a distal end of the engagement piece portion 17.

The movable cover 19 is mounted on the male connector 11 in surrounding relation to the outer periphery of the fitting portion 15, and is movable in the connector-fitting and connector-disconnecting directions. The movable cover 19 has an opening 21 formed in one end or side thereof which is directed in the fitting direction, and the hood portion 7 of the mating connector can be inserted into this opening 21.

The pair of compression springs 23 are provided between the fitting portion 15 and the movable cover 19, and these compression springs 23 normally urge the movable cover 19 in the fitting direction.

Projections 25, formed on an upper surface of the fitting portion 15, are engaged respectively in slots 27 in the movable cover 19, thereby preventing the movable cover 19 (urged in the fitting direction) from being disengaged from the fitting portion 15.

An engagement groove 29, in which the engagement projection 17*a* of the engagement piece portion 17 can be retainingly engaged, is formed in the upper surface of the fitting portion 15, and when the movable cover 19 is moved in the disconnecting direction, the engagement groove 29 is exposed.

When the pair of female and male connectors 3 and 11 of the above construction begin to be fitted together, the hood portion 7 of the female connector is inserted into the opening 21 provided around the male connector. Then, the engagement projection 17*a* of the engagement piece portion 17 of the female connector is brought into contact with the upper surface of the fitting portion 15 of the male connector, so that the movable cover 19 is pushed or moved in the disconnecting direction against the bias of the compression springs 23.

When the fitting connection between the two connectors 3 and 11 further proceeds as shown in FIG. 8, the engagement projection 17*a* becomes engaged in the engagement groove 29, so that the abutment of the distal end of the engagement piece portion 17 against the movable cover 19 is canceled. As a result, the movable cover 19 is moved in the fitting direction by the urging force of the compression springs 23, and a top wall of the movable cover 19 overlies the engagement piece portion 17, thereby preventing the engagement projection 17*a* from being disengaged from the engagement groove 29. As a result, the female and male connectors 3 and 11 are completely fitted together.

If the two connectors 3 and are inadequately pushed toward each other in the fitting direction, so that they are half fitted together, the engagement projection 17*a* fails to reach the engagement groove 29, and therefore the engagement piece portion 17 is pushed back through the movable cover 19 by the urging force of the compression springs 23, so that the two connectors 3 and 11 are moved away from each other, and therefore this half-fitted condition can be detected.

However, in the above conventional half-fitting prevention connectors 3 and 11, the movable cover 19 is provided in surrounding relation to the outer periphery of the fitting portion 15, and therefore when fitting the two connectors 3 and 11 together, the movable cover 19 is liable to be held by the hand or fingers of the operator. If the movable cover 19 is held by the hand or fingers, there is encountered a problem that the movable cover 19 can not be moved, so that the two connectors can not be fitted together.

And besides, in the connectors 3 and 11, the engagement piece portion 17 can be elastically deformed or flexed relative to the hood portion 7 in a direction perpendicular to the upper outer surface of the connector (that is, in the direction of the height of the connector) so that the engagement piece portion 17 can engage the movable cover 19 and the engagement groove 29, and therefore these members must be arranged in the direction of the height, which has resulted in a problem that the size of the housings particularly in the direction of the height is increased.

Furthermore, with respect to the male connector 11, the movable cover 19 is provided in surrounding relation to the outer periphery of the fitting portion 15, and the pair of compression springs 23 are provided respectively at the opposite sides of the male connector so that the movable cover 19 can make a parallel movement. This has invited a problem that the housing is much increased in size, and therefore the connector has a large size.

SUMMARY OF THE INVENTION

The present invention has been made in view of the above problems, and an object of the invention is to provide a half-fitting prevention connector in which movable portions are prevented from being held by the hand during a connector-fitting operation, thereby enhancing the efficiency of the fitting operation, and also a housing is prevented from having an increased size, thereby achieving a compact design of the connector.

The above object of the present invention has been achieved by a half-fitting prevention connector wherein a resilient member is mounted on one of a pair of female and male connectors to be fitted together, and when the two connectors are half fitted together, the two connectors are moved away from each other by resiliency of the resilient member, thereby detecting this half-fitted condition; provided in that a lock portion and a stopper projection are formed in a juxtaposed manner on a flat surface portion of an outer periphery of a housing of one of the two connectors, and the lock portion and the stopper projection are spaced a predetermined distance from each other in a direction perpendicular to a connector-fitting direction; and an elastic lock arm and a slider are formed on an outer periphery of a housing of the other connector, and when the two connectors begin to be fitted together, the elastic lock arm is brought into sliding contact with a slanting surface of the lock portion, and is elastically flexed toward the stopper projection, and the slider is urged in a fitting direction through the resilient member, and can be pressed by the flexed elastic lock arm so as to abut against the stopper projection.

In the half-fitting prevention connector of the above construction, when the two connectors are to be fitted together, the elastic lock arm of the other connector is brought into sliding contact with the slanting surface of the lock portion of the one connector, and is flexed toward the stopper projection, so that the elastic lock arm presses the slider formed on the other connector.

When the fitting connection between the two connectors proceeds, the pressed slider abuts against the stopper projection of the one connector, and is moved back against the bias of the resilient member. The resilient force, stored at this time, serves as a force to urge the two connectors away from each other when the two connectors are in a half-fitted condition, and the two connectors are moved away from each other, so that the half-fitted condition can be easily detected.

When the fitting connection between the two connectors further proceeds, the distal end of the elastic lock arm of the other connector slides over the lock portion of the one connector, and is retained.

At this time, the elastic lock arm is elastically restored toward the lock portion, and also the slider is elastically restored, so that its distal end is released from the abutted condition, and the slider is caused to enter the gap between the lock portion and the stopper projection by the urging force of the resilient member. As a result of entry of the distal end portion of the slider into the gap, the elastic lock arm is prevented from being flexed, and the two connectors are locked in the completely-fitted condition.

For canceling the fitting connection between the two connectors, the rear end of the elastic lock arm, projecting from the other connector, is pressed down, and by doing so, the retaining engagement of the distal end of the elastic lock arm with the lock portion can be easily canceled.

The movement of the elastic lock arm and the movement of the slider are effected in a common plane, and therefore the arrangement of the members or parts in the direction of the height of the connector is suppressed, and besides the intended function can be obtained with the use of only one resilient member, and therefore the housing is prevented from having an increased size, and the connector can have a compact design.

In the half-fitting prevention connector, preferably, the elastic lock arm and the slider are covered with a cover portion which is open in the fitting direction.

In the half-fitting prevention connector of the above construction, the elastic lock arm and the slider are covered with the cover portion, and therefore when the two connectors are to be fitted together, the elastic lock arm and the slider (which are the movable portions) will not be held by the hand of the operator, and the connector-fitting operation for connecting the two connectors together can be carried out efficiently.

DETAILED DESCRIPTION OF THE PREFERRED EMBODIMENTS

Figure 1:
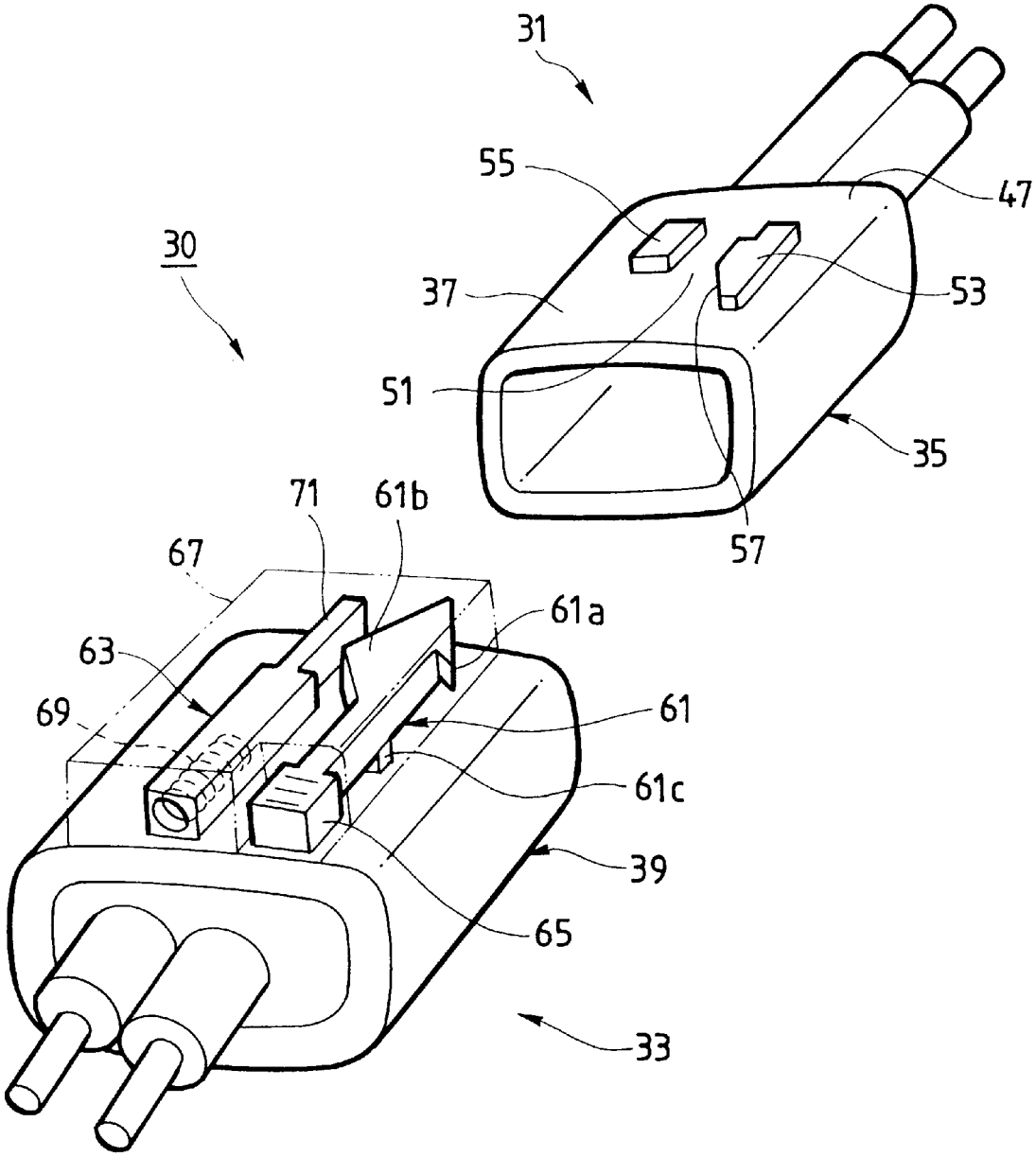
FIG. 1 is a partly see-through, exploded perspective view of a half-fitting prevention connector of the present invention.
Figure 3:
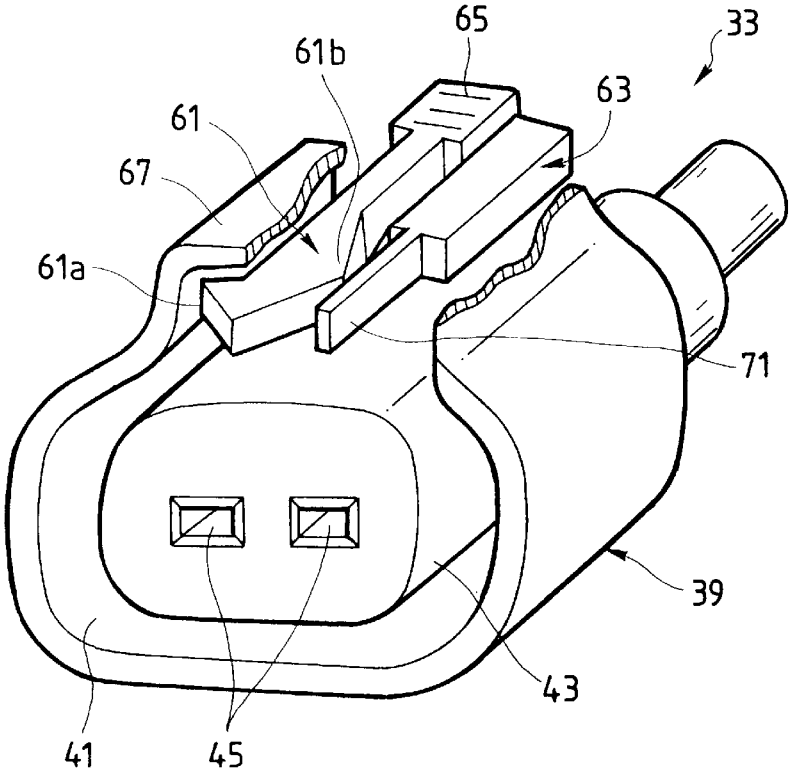
FIG. 3 is a partly-broken, perspective view of a male connector of FIG. 1.
Figure 4:
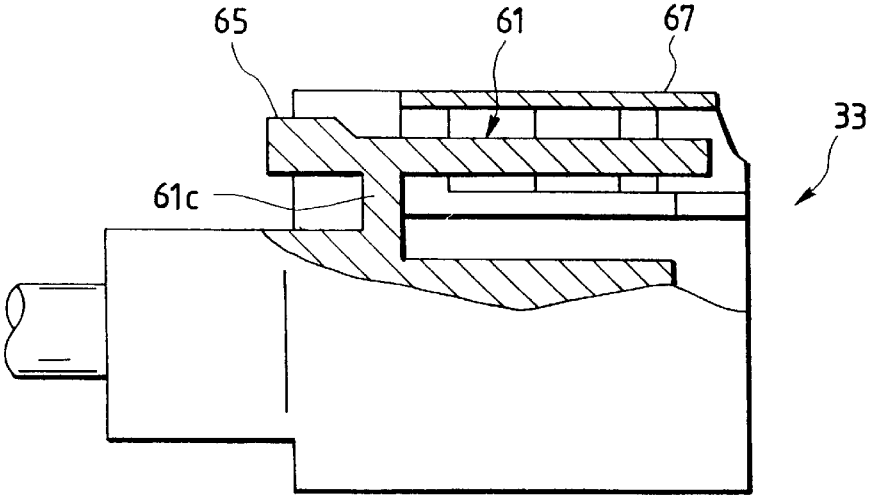
FIG. 4 is a cross-sectional view through an elastic lock arm of the male connector of FIG. 1.
Figure 5:
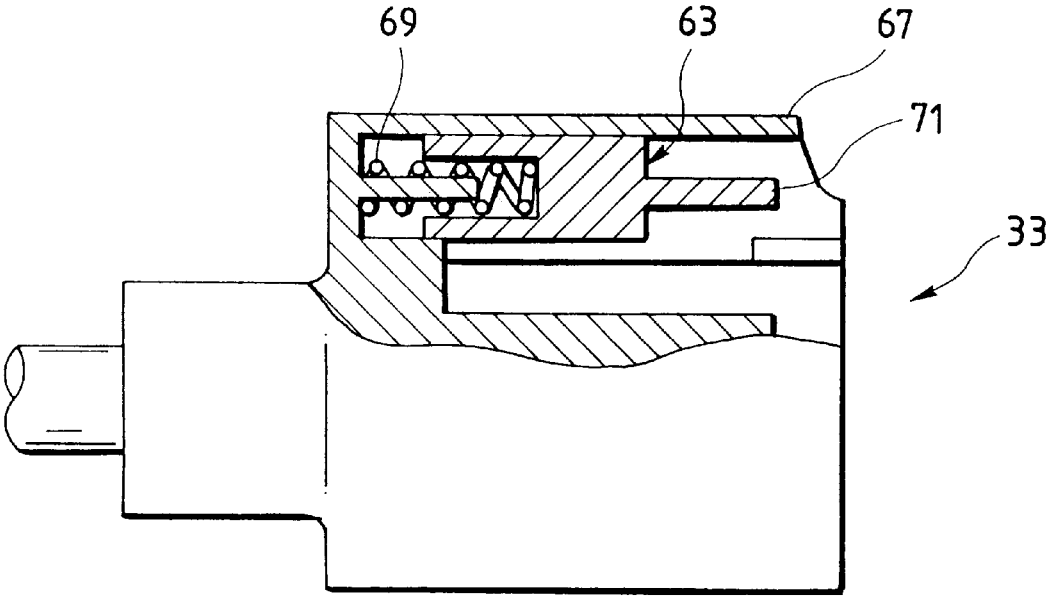
FIG. 5 is a cross-sectional view through a slider of the male connector of FIG. 1.

One preferred embodiment of a half-fitting prevention connector of the present invention will now be described in detail with reference to FIGS. 1 to 6. FIG. 1 is a partly see-through, exploded perspective view of the half-fitting prevention connector of the present invention, FIG. 2 is a partly-broken, plan view of the connector of FIG. 1, FIG. 3 is a partly-broken, perspective view of a male connector of FIG. 1, FIG. 4 is a cross-sectional view through an elastic lock arm of the male connector of FIG. 1, FIG. 5 is a cross-sectional view through a slider of the male connector of FIG. 1, and FIG. 6 is a view showing the process of a fitting operation in FIG. 1.

As shown in FIG. 1, the half-fitting prevention connector 30 of this embodiment comprises a pair of female and male connectors 31 and 33 to be fitted together.

Figure 2:
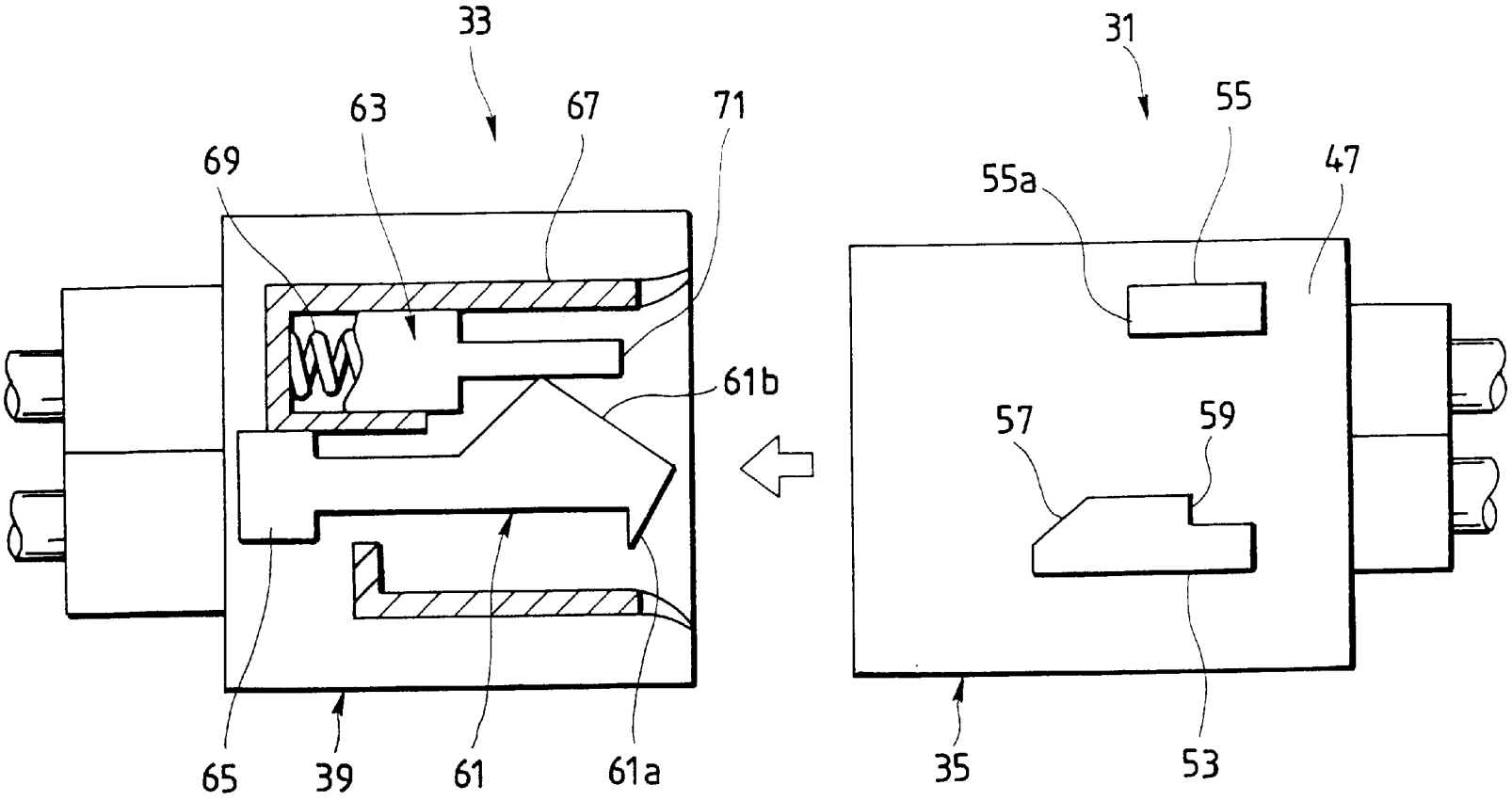
FIG. 2 is a partly-broken, plan view of the connector of FIG. 1.

As shown in FIGS. 1 and 2, a hood portion 37 is formed at a front end portion (in a fitting direction) of a housing 35 of the female connector 31, and is open in the fitting direction, and a plurality of pin contacts (not shown) are mounted in a juxtaposed manner within the hood portion 37. One side or face of the outer periphery of the housing 35 of the female connector 31 is defined by a flat surface portion 47. A lock portion 53 and a stopper projection 55 are formed on this flat surface portion 47, and are spaced a distance 51 from each other in a direction perpendicular to the connector-fitting direction.

A slanting surface 57 is formed at an inner corner portion of a front end of the lock portion 53, and a retaining step portion 59 is formed at an inner corner portion of a rear end of this lock portion. The stopper projection 55 projects from the flat surface portion 47, and an abutment surface 55a, which is perpendicular to the flat surface portion 47, is formed at a front end of the stopper projection 55.

As shown in FIGS. 1 and 3, an opening 41 for receiving the hood portion 37 is formed in a front end portion (in the fitting direction) of a housing 39 of the male connector 33, and a fitting portion 43 for insertion into the hood portion 37 is formed in a projected manner within the opening 41. A plurality of insertion holes 45 for respectively receiving the pin contacts are formed in a front end of the fitting portion 43. A plurality of contact receiving chambers (not shown) are formed in the fitting portion 43, and communicate with the insertion holes 45, respectively, and socket contacts (not shown) to be connected respectively to the pin contacts are received in these contact receiving chambers, respectively.

The elastic lock arm 61 is formed on an upper surface of the housing 39 of the male connector 33, and extends in the direction of fitting of the male connector 33, and is connected to and supported on the housing 39 at its intermediate portion (support portion 61*c*).

A retaining claw 61*a* is formed at an outer side of a front end of this elastic lock arm 61, and when the connector-fitting operation is started, this retaining claw 61*a* is brought into sliding contact with the slanting surface 57 of the lock portion 53. The retaining claw 61*a* is brought into sliding contact with the slanting surface 57 of the lock portion 53 at the time of starting the connector-fitting operation, so that the elastic lock arm 61 is elastically deformed or flexed toward the slider 63 (more fully described later).

When the two connectors are completely fitted together, the retaining claw 61*a* is retained by the retaining step portion 59 of the lock portion 53. An angle portion 61*b* is formed at the inner side of the front end portion of the elastic lock arm 61, and-this angle portion 61*b* is abutted against the slider 63.

As shown in FIG. 4, a press portion 65 for canceling the retaining engagement is formed at a rear end of the elastic lock arm 61, and when this press portion 65 is pressed down, the front portion of the elastic lock arm 61 is turned or displaced upwardly on the support portion 61 serving as a fulcrum. As a result, the retaining engagement of the retaining claw 61*a* with the retaining step portion 59 is canceled. This press portion 65 is not covered with a cover portion 67 (described later), but is exposed to the exterior so that it can be pressed or manipulated.

As shown in FIG. 5, the bar-like slider 63 is provided within the housing 39, and is disposed adjacent to the elastic lock arm 61, and this slider 63 is movable in the connector-fitting and connector-disconnecting directions. A compression spring (resilient member) 69 is mounted in a rear portion of the slider 63, and normally urges the slider 63 in the fitting direction.

An elastic rod portion 71 is formed at a front end of the slider 63, and is normally held in contact with the angle portion 61*b* formed on the inner side surface of the elastic lock arm 61, and this rod portion 71 is so positioned that it can enter the gap 51 at the time of starting the fitting operation.

The housing 39 of the male connector 33 has the cover portion 67 (shown in phantom in FIG. 1) with an open front end, and this cover portion 67 covers the elastic lock arm 61 and the slider 63.

Next, the fitting operation of the half-fitting prevention connector of the above construction will be described with reference to FIGS. 6(A) to 6(C).

Figure 6A:
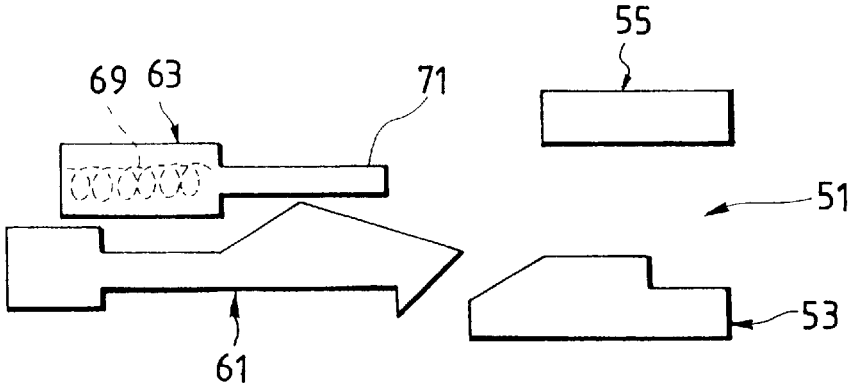
FIGS. 6(A)–6(C) are views of important portions of the half-fitting prevention connector of the invention, showing the process of a fitting operation, FIG. 6(A) showing a fitting-initiated condition, FIG. 6(B) showing a half-fitted condition, and FIG. 6(C) showing a completely-fitted condition.

First, the two connectors 31 and 33 are located in their respective fitting-starting positions, as shown in FIG. 6(A). At this time, the slider 63 is urged forwardly by the compression spring 69, and the rod portion 71, formed at the front end of this slider, is directed toward the gap 51 at the female connector 31.

Then, when the fitting connection between the two connectors 31 and 33 is started, the hood portion 37 of the female connector 31 is inserted into the opening 41 in the male connector 33. Then, when the fitting portion 43 is inserted into the hood portion 37, the retaining pawl 61*a,* formed at the front end of the elastic lock arm 61, is brought into contact with the slanting surface 57 of the lock portion 53, so that the elastic lock arm 61 is elastically deformed or flexed toward the stopper projection 55, as shown in FIG. 6(B).

As a result of flexing of the elastic lock arm 61, the angle portion 61*b* of the elastic lock arm 61 causes the rod portion 71 of the slider 63 to be flexed in the same direction. As a result of this flexing, the distal end of the rod portion 71 abuts against the abutment surface 55*a* of the stopper projection 55. In this condition, when the fitting connection between the two connectors 31 and 33 further proceeds, the slider 63 is moved back by the stopper projection 55 against the bias of the compression spring 69.

Figure 6B:
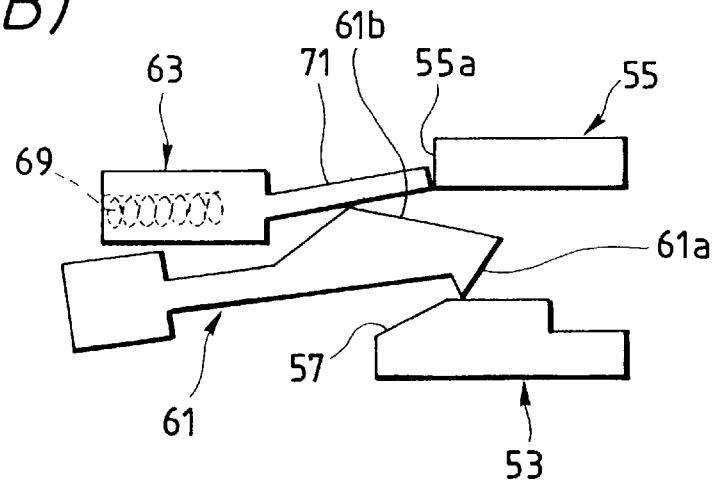
Figure 6C:
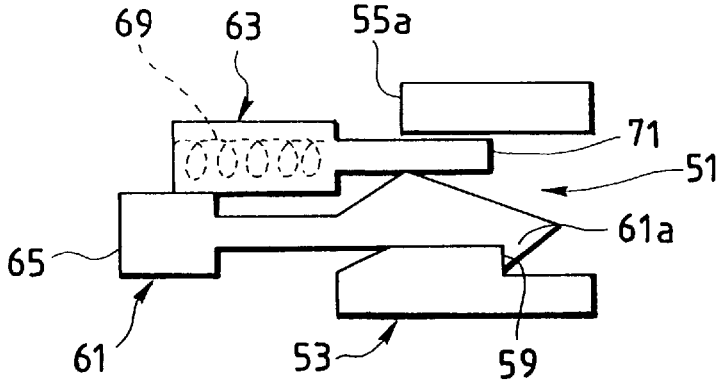
Figure 7:
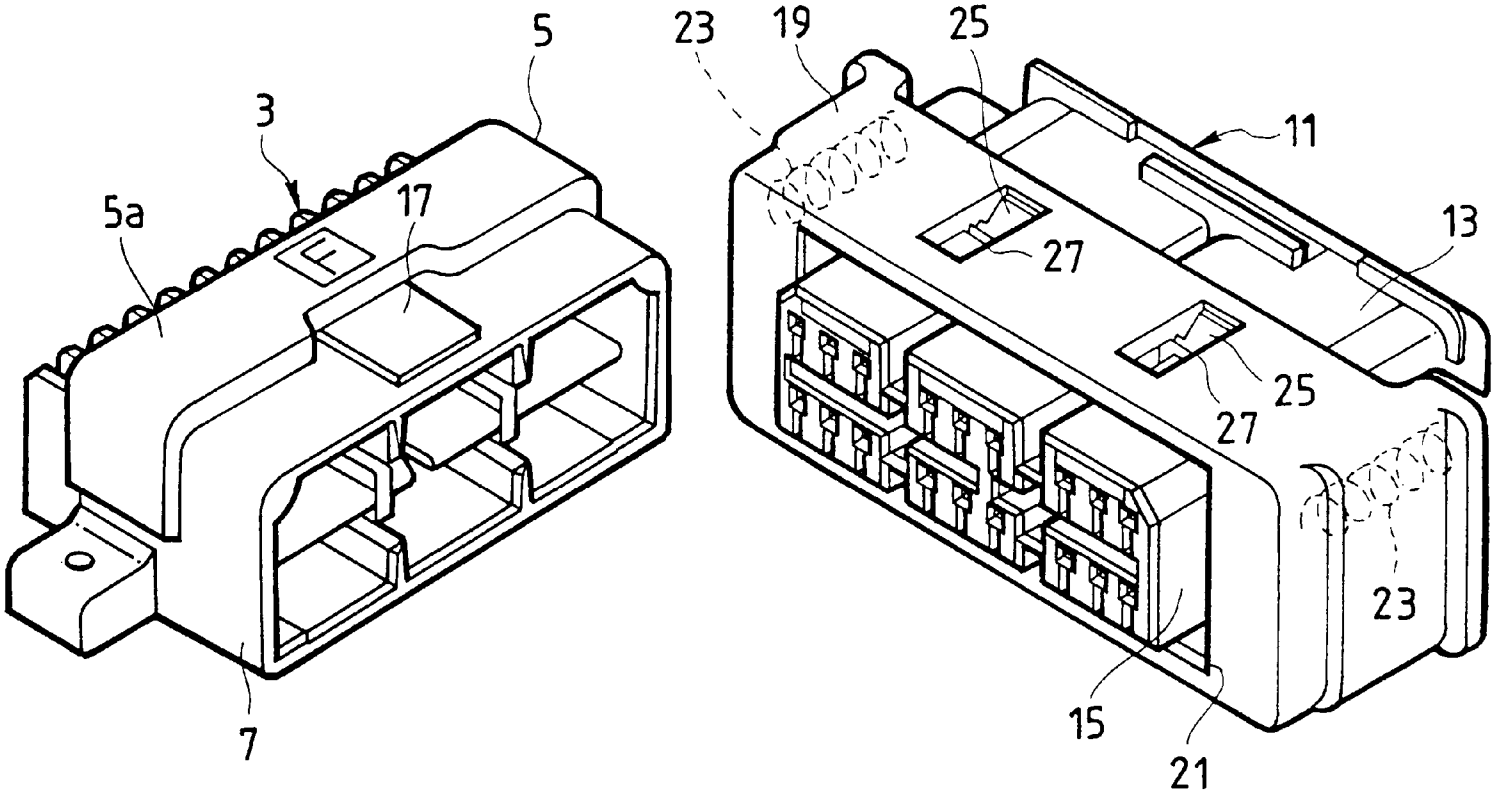
FIG. 7 PRIOR ART
FIG. 7 is a perspective view of a conventional half-fitting prevention connector.
Figure 8:
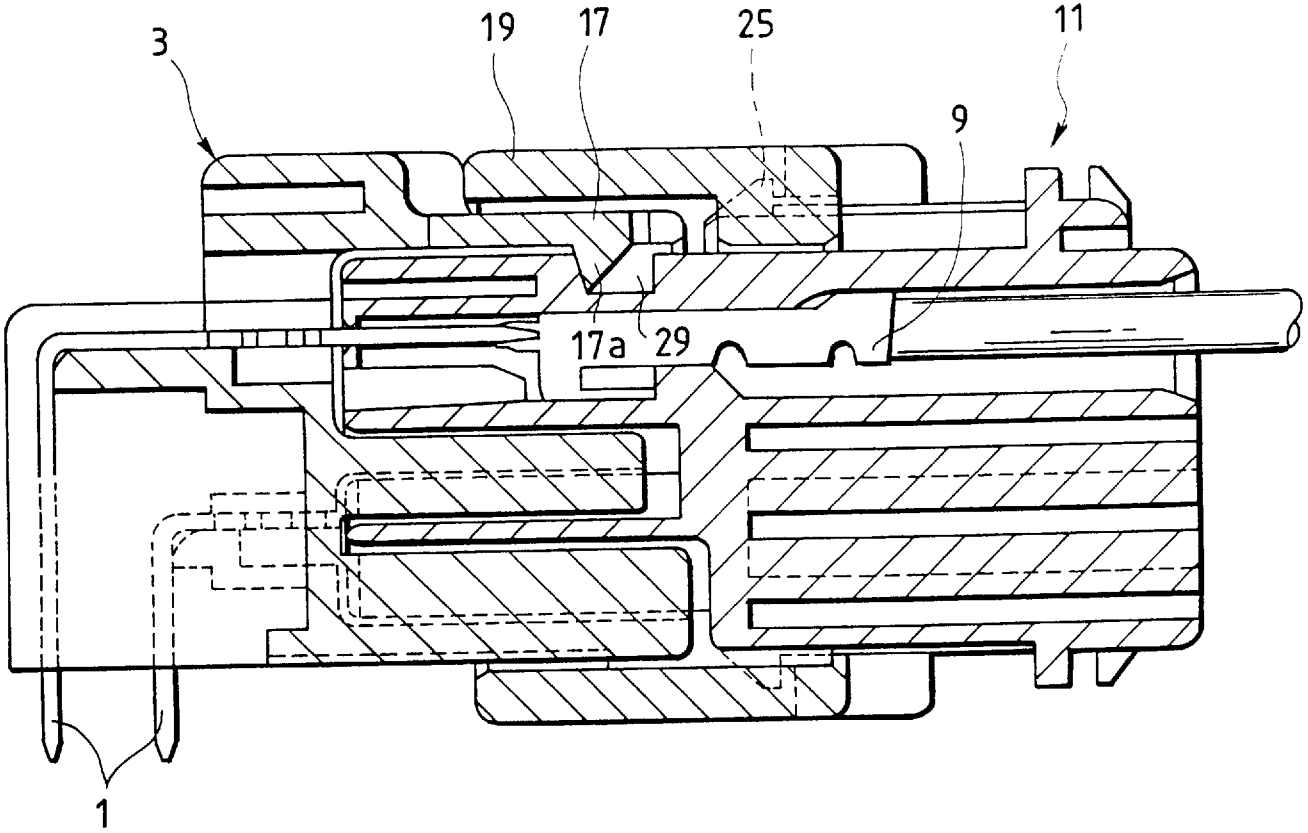
FIG. 8 PRIOR ART
FIG. 8 is a cross-sectional view, showing a fitted condition in FIG. 7.

When the fitting connection between the two connectors 31 and 33 further proceeds, the retaining claw 61*a* of the elastic lock arm 61 reaches the retaining step portion 59 of the lock portion 53, and therefore the retaining claw 61*a* is retained by the retaining step portion 59 as shown in FIG. 6(C), so that the elastic lock arm 61 is elastically restored in a direction toward the lock portion 53, and therefore is released from the flexed condition. As a result, the rod portion 71 of the slider 63 is also elastically restored to be released from the flexed condition, and is brought out of abutting engagement with the abutment surface 55*a*, and can enter the gap 51.

Therefore, the slider 63 is again moved forward in the fitting direction by the urging force of the compression spring 69, and enters the gap 51. As a result of entry of he rod portion 71 into the gap 51, a flexing space is eliminated, and therefore the elastic lock arm 61 is prevented from being flexed in the gap 51, and the two connectors 31 and 33 are locked together in the completely-fitted condition.

For canceling the fitting connection between the two connectors 31 and 33, the press portion 65 of the elastic lock arm 61, projecting from the cover portion 67 of the male connector 33, is pressed down from the upper side. As a result of this pressing operation, the retaining claw 61*a* at the front end of the elastic lock arm is turned or displaced upwardly on the support portion 61*c* serving as a fulcrum, so that the retaining engagement of the retaining claw 61*a* with the retaining step portion 59 is canceled.

When the two connectors 31 and 33 are in a half-fitted condition prior to the completely-fitted condition, the rod portion 71 of the slider 63 is abutted against the abutment surface 55*a* of the stopper projection 55 as shown in FIG. 6(B), so that the urging force of the compression spring 69 urges the two connectors 31 and 33 away from each other. Therefore, when the force, acting in the fitting direction, is reduced, the two connectors 31 and 33 are moved away from each other, and this half-fitted condition can be easily detected.

In the above half-fitting prevention connector 30 of this embodiment, the elastic lock arm 61 and the slider 63 are covered with the cover portion 67, and therefore the elastic lock arm 61 and the slider 63 (which are the movable portions) will not be held by the hand when fitting the two connectors 31 and 33 together. Therefore, the fitting operation for fitting the two connectors together can be effected positively and easily, and the fitting operation can be carried out efficiently.

And besides, the flexing of the elastic lock arm 61, the movement of the slider 63, and the flexing of the rod portion 71 are effected in a common plane, and therefore the outer size of the connector housing can be reduced.

Furthermore, the bar-like slider (movable member) 63 is used instead of a movable cover, and therefore the outer size of the connector housing can be reduced, and besides only one compression spring 69 is needed for urging the bar-like slider 63, and therefore the number of the component parts can be reduced.

As described above, in the half-fitting prevention connector of the present invention, the lock portion and the stopper projection are formed in a juxtaposed manner on the flat surface portion of the outer periphery of the housing of one of the two connectors, and the lock portion and the stopper projection are spaced a predetermined distance from each other in the direction perpendicular to the connector-fitting direction, and the elastic lock arm and the slider are formed on the outer periphery of the housing of the other connector, and when the two connectors begin to be fitted together, the elastic lock arm is brought into sliding contact with the slanting surface of the lock portion, and is elastically flexed toward the stopper projection, and the slider is urged in the fitting direction through the resilient member, and can be pressed by the flexed elastic lock arm so as to abut against the stopper projection.

The movement of the elastic lock arm, the movement of the slider, and the flexing of the slider are all effected in the common plane, and therefore the outer size of the connector housing is prevented from being increased, and the connector can have a compact design.

In the half-fitting prevention connector, the elastic lock arm and the slider are covered with the cover portion which is open in the fitting direction, and therefore when the two connectors are to be fitted together, the elastic lock arm and the slider (which are the movable portions) will not be held by the hand of the operator, and the fitting operation for connecting the two connectors together can be effected efficiently.

What is claimed is:

1. A half-fitting prevention connector comprising:

a female connector and a male connector to be fitted together;

a resilient member mounted on one of said female and said male connectors;

a lock portion and a stopper projection formed in a juxtaposed manner on an outer periphery of a housing of one of said two connectors, and said lock portion and said stopper projection being spaced a predetermined distance from each other in a lateral direction perpendicular to a connector-fitting direction so as to define a space therebetween; and an elastic lock arm and a slider provided on an outer periphery of a housing of the other connector and being receivable in said space, wherein when said two connectors begin to be fitted together, said elastic lock arm is brought into sliding contact with a slanting surface of said lock portion, and is elastically flexed in said lateral direction toward said stopper projection, and wherein said slider is urged in said connector-fitting direction through said resilient member, and is pressed by said flexed elastic lock arm in said lateral direction so as to abut against said stopper projection.

2. A half-fitting prevention connector according to claim 1, wherein said elastic lock arm and said slider are covered with a cover portion which is open in the fitting direction.

3. A half-fitting prevention connector according to claim 1, wherein the flexing of said elastic lock arm, the movement of said slider and the flexing of a rod portion provided in said slider are effected in a common plane.

4. A half-fitting prevention connector comprising:

a female connector and a male connector to be fitted together;

a resilient member mounted on one of said female and said male connectors;

a lock portion and a stopper projection formed in a juxtaposed manner on a portion of an outer periphery of a housing of one of said two connectors, and said lock portion and said stopper projection being spaced a predetermined distance from each other in a direction perpendicular to a connector-fitting direction; and an elastic lock arm and a slider provided on an outer periphery of a housing of the other connector, wherein when said two connectors begin to be fitted together, said elastic lock arm is brought into sliding contact with a slanting surface of said lock portion, and is elastically flexed toward said stopper projection, and wherein said slider is urged in said connector-fitting direction through said resilient member, and is pressed by said flexed elastic lock arm so as to abut against said stopper projection, wherein the flexing of said elastic lock arm, the movement of said slider and the flexing of a rod portion provided in said slider are effected in a common plane.

* * * * *